US011785691B2

(12) United States Patent
Saes

(10) Patent No.: US 11,785,691 B2
(45) Date of Patent: Oct. 10, 2023

(54) CONTROL CIRCUITS AND METHODS FOR DRIVING AT LEAST ONE LED GROUP

(71) Applicant: eldoLab Holding B.V., Son en Breugel (NL)

(72) Inventor: Marc Saes, Eindhoven (NL)

(73) Assignee: eldoLAB Holding B.V., Son en Breugel (NL)

( * ) Notice: Subject to any disclaimer, the term of this patent is extended or adjusted under 35 U.S.C. 154(b) by 370 days.

(21) Appl. No.: 17/253,429

(22) PCT Filed: Jul. 8, 2019

(86) PCT No.: PCT/NL2019/050425
§ 371 (c)(1),
(2) Date: Dec. 17, 2020

(87) PCT Pub. No.: WO2020/013688
PCT Pub. Date: Jan. 16, 2020

(65) Prior Publication Data

US 2021/0259079 A1 Aug. 19, 2021
US 2022/0086987 A2 Mar. 17, 2022

(30) Foreign Application Priority Data

Jul. 9, 2018 (NL) ..... 2021270

(51) Int. Cl.
*H05B 45/48* (2020.01)
*H05B 45/3725* (2020.01)

(52) U.S. Cl.
CPC ..... *H05B 45/48* (2020.01); *H05B 45/3725* (2020.01)

(58) Field of Classification Search
CPC .... H05B 45/10; H05B 45/30; H05B 45/3725; H05B 45/48; H05B 47/10
See application file for complete search history.

(56) References Cited

U.S. PATENT DOCUMENTS 8,742,682 B1 * 6/2014 Wang ..... H05B 45/54 315/318
9,345,087 B2 * 5/2016 Yu ..... H05B 45/48

FOREIGN PATENT DOCUMENTS

WO 2009013676 A2 1/2009
WO 2013110052 A1 7/2013

OTHER PUBLICATIONS

Netherlands Search Report and Written Opinion for NL Application No. 2021270, dated Sep. 19, 2019, 14 pages.

(Continued)

*Primary Examiner* — Jimmy T Vu
(74) *Attorney, Agent, or Firm* — RatnerPrestia

(57) ABSTRACT

A control circuit and method are provided for a controlled start-up of N LED groups. The control circuit comprising a LED switching element and a chargeable element in parallel with each LED group, and a low-power source. The method comprising a step of prior to supplying power to the LED groups, setting the LED switching elements in a second state corresponding with the LED group being off. Alternatively, a lower chargeable element is connected via a diode with the top of a higher chargeable element. The control circuit may further comprise a switch having a lighting mode wherein current flows through the LED groups or the corresponding LED switching elements, and a charging mode wherein current flows to the chargeable elements, thereby charging the chargeable elements.

21 Claims, 4 Drawing Sheets

(56) References Cited

OTHER PUBLICATIONS

International Search Report for International Application No. PCT/NL2019/050425, dated Sep. 19, 2019, 2 pages.

* cited by examiner

CONTROL CIRCUITS AND METHODS FOR DRIVING AT LEAST ONE LED GROUP

This application is a U.S. National Phase Patent Application of International Application Number PCT/NL2019/050425, filed Jul. 8, 2019, which claims priority to Netherlands Application No. NL 2021270, filed Jul. 9, 2018, the disclosures of which are incorporated herein by reference in their entirety for all purposes.

The invention pertains to LED lighting and the control thereof, in particular to circuits wherein a chargeable element supplies power to a switching element that controls individual LEDs or LED groups.

At present, conventional lighting applications are more and more replaced by Light Emitting Diode (LED) illumination systems. In general, an LED based lighting application comprises an LED fixture comprising one or more LEDs, and an LED driver for powering the LED fixture. Such an LED driver in general comprises a control such as a switched mode power supply (e.g. a Buck or Boost converter) and a control unit for controlling the control and/or the LED fixture. Optionally, an extra control circuit can be provided for additional control of the LED fixture.

In general, LED based illumination can provide several advantages over conventional lighting applications, such as incandescent lamps or the like, as it enables an increased functionality. Often, a LED fixture comprises multiple LEDs or multiple LED groups, which are placed either in series or in parallel relative to each other and driven by the same LED driver. The individual LED groups can then be individually controlled. This can be beneficial to achieve a desired brightness, intensity, colour, or colour temperature. The most common way to control the individual LED groups is with help of a switching element such as a bipolar junction transistor (BJT), field-effect transistor (FET) or metal-oxide-semiconductor field-effect transistor (MOSFET). In order to be able to properly control the switching element, power is needed, e.g. to supply a sufficiently large gate-source voltage or base-emitter voltage. This power is usually supplied by the same source that supplies power to the LEDs, or by an energy storage element such as a capacitor. However, this entails that no energy can be provided before the LEDs are turned on, especially if they have been turned off for a considerable period of time. As a result thereof, the initial state of the LEDs after the power is turned on is determined by the topology of the circuit, and cannot be adapted based on an input by a user. Thus, a need exists for a method and control circuit that allows a controlled start-up of multiple LEDs or LED groups.

When a switching element such as a FET, mosFET or BJT is placed in parallel with a LED or LED group in order to control that LED or LED group, often a chargeable element such as a capacitor is used to supply the gate-source voltage or base-emitter voltage. As long as the LED or LED group is emitting light, there is voltage drop over the LED or LED group and thus over the capacitor which is in parallel, which results in the capacitor being charged. However, if the LED or LED group is not emitting light, e.g. when the switching element conducts current, the voltage drop may not be sufficient to charge the capacitor. Due to leakage currents, the capacitor will eventually lose the voltage potential, and thereby the gate-source voltage or base-emitter voltage will drop as well. The switching element and the corresponding LED or LED group cannot be controlled as desired. A need exists for a method and control circuit that allows to charge the chargeable element even if the corresponding LED or LED group is turned off for a considerable period of time.

In view of the above, it is an object of the present invention to provide a control circuit for at least one LED group and a method of operating at least one LED group mitigating at least one of the drawbacks mentioned, or at least provide an alternative.

According to a first aspect of this invention, this object is achieved by a method for a controlled start-up of N LED groups by means of a control circuit, wherein the LED groups are connected to each other in series, each LED group comprises at least one LED, N is larger than one;

wherein the control circuit comprises:

- a supply-power line configured to be connected to a supply-power source which powers the LED groups;
- a plurality of connection terminals for connecting the LED groups to the control circuit such that each LED group is connected to a pair of connection terminals comprising an upper connection terminal and lower connection terminal, wherein
  - i. for two successive LED groups the lower connection terminal of a first of the two successive LED groups is either connected to or is the same as the upper connection terminal of a second of the two successive LED groups,
  - ii. a top connection terminal is connected to the supply-power line,
  - iii. a bottom connection terminal is configured to be connected to a ground,
- N LED switching elements, each connected between a corresponding pair of the connection terminals, and configured to be in parallel with a corresponding LED group, wherein each LED switching element has a first state corresponding with said LED group being on and a second state corresponding with said LED group being off,
- N chargeable elements each connected between a corresponding pair of the connection terminals, and configured to be in parallel with both a corresponding LED switching element and a corresponding LED group, wherein each chargeable element enables, when charged, the corresponding LED switching element to switch from the first state to the second state;
- a low-power source;

wherein the method comprises the following steps:

prior to supplying power via the supply-power line:

- setting all LED switching elements in the second state by charging the chargeable elements with the low-power source, supplying power via the supply-power line.

In accordance with the fist aspect of the invention, a method for a controlled start-up of multiple LED groups with a control circuit is provided. The first aspect of the invention also relates to the control circuit used in the method, which control circuit is also referred to as a control circuit according to the first aspect of the invention. In the context of this invention, a start-up is to be understood as the transition from a situation wherein the LED groups are not desired to emit light and no power is supplied, to a situation wherein power is supplied. The start-up can be executed on command of a user, e.g. by a light switch, or on command of an automated system, e.g. in case of a system-controlled lighting such as LED-display, LED-screen or sensor-based lighting system.

The method according to the invention may be used for the start-up of N LED groups, wherein N is larger than 1. In the context of this invention, each LED group is considered to comprise at least one LED, but can also comprise multiple LEDs, e.g. four LEDs in series or parallel. Those LEDs can be of the same rating or of a different rating, and they can be the same colour or different colours. The multiple LED groups can be but do not need to be identical to each other. The LED groups are meant to be connected to each other in series.

The LED groups are connected, directly or indirectly, to a supply-power line which is configured to be connected to a supply-power source, which powers the LED groups. The supply-power line is comprised by the control circuit, but the supply-power source does not need to be comprised by the control circuit. The supply-power source can be a voltage source or a current source. It can comprise a power converter such as Buck, Boost or flyback converter for providing a current.

The control circuit comprises a plurality of connection terminals which are adapted to connect a LED group to the control circuit. When connected, each LED group has an upper connection terminal and a lower connection terminal. For two successive LED groups, the lower connection terminal of the first of the two successive LED groups is either connected to or the same as the upper connection terminal of the second of the two successive LED groups. Thus, it is possible for the control circuit to comprise N pairs of connection terminals, such that each LED group can be connected to an individual pair of connection terminals. However, it is also possible for one or more connection terminals to be configured to be connected to more than one LED group. In that case, such a connection terminal serves as lower connection terminal for one LED group and as upper connection terminal for another LED group.

The LED groups are not part of the control circuit, although it is possible for the control circuit and the LED groups to be integrated or even to be arranged on a single physical board. Advantageously it is also possible that the LED groups are physically separated from the control circuit, e.g. on a separate physical board. It is also possible for the control circuit and the LED groups to be detachably or removably connected. This allows to connect any LED group to the control board, and to replace an individual LED or LED group, e.g. when it malfunctions or a different colour or colour temperature is desired.

In the control circuit a top connection terminal is connected, directly or indirectly, e.g. via one or more transistors, to the supply-power line and a bottom connection terminal is connected, directly or indirectly, e.g. via one or more transistors, to a ground. It should be noted that in the context of this invention, terms such as "first", "upper", "higher" and "top" are considered to indicate upstream of the flow of current relative to terms as "second", "last", "lower" or "bottom".

The control circuit according to the first aspect of the invention comprises N LED switching elements, each connected between an upper and lower connection terminal. The LED switching element is in parallel with a corresponding LED group when said LED group is connected between the upper and lower connection terminal. As such, each LED group can be individually controlled by a LED switching element. That is, each LED group can individually be turned on, i.e. emitting light, or off, i.e. not emitting light. The LED switching element has a first state and a second state, wherein the first state corresponds with the LED group being on and the second state corresponds with the LED group being off. The LED switching element can be component such as any kind of BJT, FET, MOSFET or other transistor. For example, in the first state the LED switching behaves as an open circuit, such that the current flows through the LED group that is in parallel with the respective LED switching element, and in the second state, the LED switching element is set to conduct current, such that substantially no current is conducted by the corresponding LED group. The LED switching element may e.g. be a power MOSFET, which advantageously has a high switching speed and good efficiency at low voltages.

The control circuit further comprises N chargeable elements, also each connected between an upper and a lower connection terminal, optionally via diodes and optionally comprising additional electrical components, e.g. resistors, between said upper and lower connection terminal in series with the chargeable element. The chargeable element is in parallel with both the corresponding LED switching element and the corresponding LED group when said LED group is connected to the control circuit. The chargeable element enables, when charged, the LED switching element to switch from the first state to the second state. The chargeable element can e.g. be a capacitor which supplies a voltage that enables switching of a transistor, e.g. by providing the gate-source voltage for a FET or the base-emitter voltage for a BJT, e.g. by being connected to the gate and the source or the base and the emitter.

By controlling which LED groups are on and which are off, characteristics of the emitted light such a brightness, intensity and/or colour can be controlled. In order for each LED group to be properly controlled, the corresponding LED switching element must be in the correct state, i.e. the first or the second state. For the LED switching element to be able to be in that correct state, the chargeable element must be charged, such that the LED switching element can work properly. Thus, the chargeable element must be charged in order to be able to control the LED groups properly. However, prior to the start-up, the supply-power source does not supply any power, meaning that the chargeable element cannot be charged by the supply-power source. It should further be noted if the chargeable element was charged in a previous lighting cycle, i.e. the last time the LED groups were emitting light, leakage currents may have caused the chargeable element to become uncharged. This results in uncertainty about the state of the LED switching elements, which leads to an uncontrolled start-up, since the LED groups cannot be controlled properly. Therefore, according to the first aspect of the invention, the control circuit further comprises a low-power source. The low-power source will be used to ensure the controlled start-up, as will be explained in more detail below. The low-power source can e.g. be a current source or a voltage source, e.g. a voltage regulator that supplies 5V, and/or include a chargeable element such as a capacitor which is charged to a low voltage. If the LED switching elements require a voltage above a threshold voltage for proper functioning, the voltage provided by the low-power source preferably is above said threshold voltage.

The method for a controlled start-up according to the first aspect of the invention comprises a step of, prior to supplying power via the supply-power line, setting all LED switching elements in the second state by charging the chargeable elements with the low-power source. This can be understood as follows. The LED switching element corresponding with the bottom LED group is connected to the ground with the corresponding lower connection terminal. Although electrical elements such as resistors may be present between the lower connection terminal and the ground, there is no or little flow of current prior to supplying power via the supply-power line. Therefore, the lower connection terminal is at substantially 0V. Since the corresponding chargeable element is charged by the low-power source, there is a voltage difference between the charged chargeable element and the lower connection terminal. Due to this voltage difference, the LED switching element switches to the second state. The second state of the LED switching element enables an electrical connection between the corresponding lower connection terminal and upper connection terminal. As such, the upper connection terminal is at substantially the same voltage as the lower connection terminal, i.e. substantially 0V.

For the LED group above the previous LED group, the lower connection terminal corresponds with the upper connection terminal of the previous LED group or is connected to it. Thus, the lower connection terminal for the LED group above the previous LED group is at substantially 0V. The chargeable element corresponding to this LED group has been charged by the low-power source, meaning that there is again a voltage difference between the charged chargeable element and the corresponding lower connection terminal. Due to this voltage difference, the corresponding LED switching element switches to the second state. Again, the second state of the LED switching element enables an electrical connection between the lower connection terminal and the upper connection terminal, thereby setting the upper connection terminal at substantially the same voltage as the lower connection terminal.

The working principle as described above results in all LED switching elements subsequently switching into their second state. When all LED switching elements are set in the second state, all the respective lower connection terminals and upper connection terminals are electrically connected and at substantially the same voltage. Thus, the top connection terminal is at substantially the same voltage as the bottom connection terminal. As such, a situation is created wherein the state of all LED switching elements is known, as well as the voltage potential at all respective upper connection terminals and lower connection terminals. Besides being known, this situation is also independent of the behaviour of the circuit or LED groups prior to the start-up. This enhances the controllability and avoids unexpected behaviour. Finally, power is supplied via the supply-power line, thereby causing a flow of current. Since all LED switching elements are in the second state, no LED group will emit light at this moment. As can be seen, a controlled start-up has been provided.

In a possible embodiment of the method according to the first aspect of the invention comprises the step of, prior to supplying power via the supply-power line and after all LED switching elements have been set in the second state, setting the LED switching element corresponding to each LED group that is desired to be on after the start-up in the first state.

When thereafter power is supplied via the supply-power line causing a flow of current, for each LED group of which the corresponding LED switching element is in the first state, current will flow through the LED or LEDs of the LED group. As such, the LED or LEDs will emit light. As can be seen, this embodiment the method according to the first aspect of the invention ensures that the LED groups start lighting in a controlled manner. That is, the multiple LED groups, from the moment they start emitting light, emit a light that corresponds with a desired characteristic, e.g. a desired brightness, intensity or colour. Moreover, the desired characteristic can be different from one start-up to another. In other words, the light that the multiple LED groups start emitting at the moment they start emitting light, is not limited to a single intensity, brightness and colour that is determined by the topology of the circuit.

In an embodiment of the first aspect of the invention, the control circuit further comprises a control unit. The control unit comprises set-point terminal for receiving a set-point signal representing a desired illumination of the LED groups. The control unit further comprises at least one output terminal for controlling the LED switching elements. Optionally the set-point signal may be part of communication with another component, e.g. a driver. The set-point terminal may then also be used for communication with said component, e.g. the driver. Thus, the set-point terminal may be used to communicate other commands and data than the set-point signal with said component.

The set-point signal may come from a command of a user, e.g. by a light switch, or on command of an automated system, e.g. in case of a system-controlled lighting such as LED-display, LED-screen or sensor-based lighting system. The set-point signal represents a desired illumination of the LED groups. This may refer to any characteristic of the illumination, e.g. brightness, intensity, colour or temperature. The control unit can control via the output terminal whether each LED switching element is in the first state or the second state, as long as the chargeable element is charged sufficiently to ensure correct working of the LED switching element.

This embodiment of the control circuit according to the first aspect of the invention can be used in an embodiment of the method according to first aspect of the invention. Said embodiment of the method further comprises the step of, prior to supplying power via the supply-power line, determining, with the control unit, for each LED group a start-up state. Said start-up state corresponds with either being on or being off. The method further comprises the step of setting, with the control unit, the LED switching element corresponding to each LED group for which the start-up state is on in the first state.

The start-up state for each LED group is based on the set-point signal received by the control unit and is such that the LED groups together emit the desired illumination represented by said set-point signal. Once all LED switching elements are set in the second state by charging the chargeable elements, the control unit sets the LED switching element corresponding to each LED group for which the start-up state is on in the first state.

Optionally the control unit also comprises a communication terminal for communicating with a driver. As such, the control unit can inform the driver when to supply power and when not. The supply-power source to which the supply-power line is connected is controlled by a driver. The driver can control the supplying of power by turning the supply-power source on or off, or the driver can control the connection between the supply-power source and the supply-power line, e.g. by controlling a switch. When all LED switching elements are set in the correct state, the control unit may e.g. communicate to the driver that the supply-power source can supply power to the LED groups.

In an advantageous embodiment the control unit is arranged to receive a communication signal which is further arranged to charge the low-power source. The communication signal may e.g. be coming from the driver and/or comprise the set-point signal as explained above. For example, the low-power source may include a capacitor and/or voltage regulator, and the communication signal may vary between a high-voltage signal and a low-voltage signal, e.g. the high-voltage signal being 5V. The control circuit may then be arranged such that the communication signal is also connected to the low-power source, such that the high-voltage signal charges said low-power source. Advantageously no separate charging of the low-power source is required. Moreover, no separate power supply for the control circuit is required. The communication signal may e.g. come from another physical board, e.g. on which the driver is arranged, and according to this embodiment no additional connection for charging the low-power source is required.

The first aspect of the invention may be used in combination with the second and/or third aspect of the invention, which are described below. The second and third aspect can however also used in combination without the first aspect. Furthermore, each of the aspects can also be applied independently of the other aspects. It is noted that terms, definitions and features used in this text have the same or at least similar meaning for each of the aspects, unless explicitly mentioned otherwise.

According to a second aspect of the invention there is provided a control circuit for controlling X LED groups, wherein X is larger than one, preferably larger than two, wherein the LED groups are connected in series to each other and each LED group comprises at least one LED, wherein the control circuit comprises:

- a supply-power line configured to be connected to a supply-power source which powers the LED groups;
- a plurality of connection terminals for connecting the LED groups to the control circuit such that each LED group is connected to a pair of connection terminals comprising an upper connection terminal and lower connection terminal, wherein
  - i. for two successive LED groups the lower connection terminal of a first of the two successive LED groups is either connected to or is the same as the upper connection terminal of a second of the two successive LED groups,
  - ii. a top connection terminal is connected to the supply-power line,
  - iii. a bottom connection terminal is configured to be connected to a ground,
- X LED switching elements, each connected between a corresponding pair of the connection terminals, and configured to be in parallel with a corresponding LED group, wherein each LED switching element has a first state corresponding with said LED group being on and a second state corresponding with said LED group being off,
- X chargeable elements each connected between a corresponding pair of the connection terminals, and configured to be in parallel with both a corresponding LED switching element and a corresponding LED group, wherein each chargeable element enables, when charged, the corresponding LED switching element to switch from the first state to the second state;

wherein a top of at least one of the X chargeable elements, which is connected between a lower pair of connection terminals, is connected via a diode with a top of another one of the X chargeable elements, which is connected between a higher pair of connection terminals, the lower pair of connection terminals being arranged between the higher pair of connection terminals and the ground.

The control circuit according to the second aspect of the invention comprises, similarly to the control circuit according to the first aspect of the invention, a supply-power line, a plurality of connection terminals, X LED switching elements and X chargeable elements. These features may be embodied in the same way as described with respect to the first aspect of the invention. Note however that the low-power source is not required for the second aspect of the invention.

Moreover at least one additional connection between two of the X chargeable elements is provided according to the second aspect of the invention. Said connection is between a top of at least one of the X chargeable elements, which is connected between a lower pair of connection terminals, and a top of another one of the X chargeable elements, which in connected parallel with a higher pair of connection terminals. It should be noted that in the context of this invention, terms such as "first", "upper", "higher" and "top" are considered to indicate upstream of the flow of current relative to terms as "second", "last", "lower" or "bottom". The lower pair of connection terminals is arranged between the higher pair of connection terminals and the ground. The higher pair of connection terminals is thus arranged between the top connection terminal and the lower pair of connection terminals. Note that the top connection terminal may be part of the higher pair of connection terminals, and that the upper connection terminal of the lower pair of connection terminals may be the same connection terminal as the lower connection terminal of the higher pair of connection terminals. The chargeable element connected between the higher pair of connection terminals can also be referred to as the higher chargeable element, and the chargeable element connected between the lower pair of connection terminals can be referred to as the lower chargeable element, and similarly a higher LED switching element and a lower LED switching element can be identified. Said connection between said chargeable elements further comprises a diode, ensuring that current normally only flows from lower chargeable element to the higher chargeable element.

The control circuit according to the second aspect of the invention enables the higher chargeable element to be charged by the lower chargeable element. Normally said higher chargeable element provides a voltage for the LED switching element in parallel with it which enables said LED switching element to switch to the second state such that the LED group in parallel is turned off. In this situation there is substantially no voltage drop over the LED group or LED switching element, making it impossible for the higher chargeable element to charge this way. Eventually leakage currents will cause the voltage drop across the higher chargeable element to drop too low, no longer enabling proper control of the LED switching element, which will switch to the first state, thereby turning the LED group on and emitting undesired light. The second aspect of the invention provides an alternative/additional path to charge the higher chargeable element, i.e. via the top of the lower chargeable element when said top is at a higher voltage potential. This may e.g. be the case when the LED group in parallel with the lower chargeable element has been turned off later than the LED group in parallel with the higher chargeable element.

For example, each LED group may be configured to emit light with a different characteristic, e.g. different colour or intensity, and the desired emitted light may be such that the higher LED group is turned off all of the time and the lower LED group is turned on most but not all of the time. The lower LED group will then be turned off for a small period of time during each modulation cycle which allows to charge the higher chargeable element with the lower chargeable element. Alternatively the control circuit may be defined that emitted light at maximal intensity actually corresponds with the LED groups being on slightly less than 100% of the time, e.g. 90%, 95% or 99% of the time. During each modulation cycle all LED groups can then be turned off for the remaining time, thereby allowing to charge the higher chargeable element. A modulation cycle may e.g. be in the range of a few millisecond, e.g. 3.33 ms, such that the switching off of the LED groups occurs at a frequency which is not visible for the human eye or a camera.

In an embodiment of the control circuit according to the second aspect of the invention, the higher pair of connection terminals and the lower pair of connection terminals are subsequently arranged pairs of connection terminals, the lower connection terminal of the higher pair of connection terminals either being connected to or being the same as the upper connection terminal of lower pair of connection terminals.

In this embodiment the lower and higher chargeable elements are arranged subsequently of the X chargeable elements. Since normally the voltage potential decreases from higher to lower connection terminals in the control circuit, it is beneficial to have the lower chargeable element as close as possible to the higher chargeable element in the control circuit, as this increases the likelihood of the top of the lower chargeable element being at a higher voltage potential than the top of the higher chargeable element.

In an embodiment the tops of X-1 of the X chargeable elements are connected via a diode with a top of another one of the X chargeable elements, which is connected between a pair of connection terminals subsequently arranged closer to the top connection terminal.

In this embodiment advantageously X-1 of the X chargeable elements are arranged to be charged by a lower chargeable element arranged subsequently lower, or possibly even further lower. Of course the lowest chargeable element cannot be connected to a lower chargeable element, as there is none. It may therefore be advantageous to provide a low-power source, e.g. as in the first aspect of the invention, which can sufficiently charge the lowest chargeable element. It may also be advantageous to arrange the LED group which will be on in most settings as the lowest LED group, such that this problem is mostly avoided.

The second aspect of the invention further relates to a method for operating X LED-groups with a control circuit according to the second aspect of the invention, the method comprising the steps of charging the chargeable element connected between the higher pair of connection terminals by setting the LED switching element connected between the lower pair of connection terminals in the second state.

By setting the LED switching element connected between the lower pair of connection terminals in the second state the corresponding LED group is turned off and there is substantially no voltage drop across the LED switching element. The upper connection terminal of the lower chargeable element is as such brought to a lower voltage potential, as is lower connection terminal of the higher chargeable element, and the bottom of the higher chargeable element which is connected to said lower connection terminal. The top of the lower chargeable element however remains substantially at the same voltage potential, as it is protected by diodes from discharging. The difference in voltage potential between said top of the lower chargeable element and the bottom of the higher chargeable element is then higher than the voltage difference across the higher chargeable element, resulting in the top of the higher chargeable element being charged via the diode by the top of the lower chargeable element.

In an embodiment the method comprises the step of switching the LED switching element connected between the lower pair of connection terminals alternating between the first state and the second state. The period that the LED switching element is in the first state is preferably large compared to the period that the LED switching element is in the second state, preferably at least 10 times larger, preferably at least 25 times larger. This allows to emit light for the majority of the time, and have relatively small periods wherein the emitted light is disrupted and chargeable element is charged. For example, the period that the LED switching element is in the first state and the period that the LED switching element is in the second state combined may be 3.33 ms. For example, the period that the LED switching element is in the first state may be 3 ms and the period that the LED switching element is in the second state may be 0.33 ms. As such, in a total period of 3.33 ms corresponding LED group will be turned off for 0.33 ms, which will not be noticeable to the human eye.

The alternating switching of the lower LED switching element may occur when there is a risk that the higher chargeable element loses too much voltage potential, e.g. when the higher LED group is turned off and/or based on calculations and/or measurements of the voltage potential of the higher chargeable element.

The alternating switching of the lower LED switching element may also occur continuously, optionally for all LED switching elements. For example, the control circuit may be defined that emitted light at maximal intensity actually corresponds with the LED groups being on slightly less than 100% of the time, e.g. 90%, 95% or 99% of the time. During each modulation cycle all LED groups can then be turned off for the remaining time, thereby allowing to charge the higher chargeable element. A modulation cycle may e.g. be in the range of a few millisecond, e.g. 3.33 ms, such that the switching off of the LED groups occurs at a frequency which is not visible for the human eye or a camera.

In an embodiment the method comprises the steps of monitoring a time period $T_{off}$ for the LED group between the higher pair of connection terminals, when the respective LED group is turned off, comparing $T_{off}$ with an off-time limit, charging the chargeable element connected between the higher pair of connection terminals when the $T_{off}$ exceeds off-time limit. Thereafter, optionally the time period $T_{off}$ is reset to zero and the monitoring is repeated.

The time period $T_{off}$ corresponds to the period that the specific LED group is turned off wherein the chargeable element is not being charged. The off-time limit represents the maximal period that a specific LED groups should be turned off before charging the chargeable element. Thus, the off-time limit is determined based on the time it takes for the chargeable element to become uncharged. The off-time limit can be determined based on a theoretical model of the circuit, and/or on empirical data e.g. obtained by a prototype of the circuit, and/or on empirical data obtained by monitoring the behaviour of the actual circuit. When multiple LED groups are present, the off-time can be different for each chargeable element. The charging is done by setting the LED switching element connected between the lower pair of connection terminals in the second state.

In an embodiment the method comprises the steps of: monitoring a voltage potential $V_C$ over the chargeable element between the higher pair of connection terminals, comparing the voltage potential $V_C$ to a threshold voltage, and charging the chargeable element connected between the higher pair of connection terminals before the voltage potential $V_C$ falls below the threshold voltage.

Monitoring the voltage potential $V_C$ can be achieved by any voltage measuring method known the skilled person. The threshold voltage can be predetermined and can be dependent on the voltage that is needed to ensure correct functioning of the corresponding LED switching element. The charging is done by setting the LED switching element connected between the lower pair of connection terminals in the second state.

In a further embodiment it is also possible to keep monitoring the voltage potential $V_C$ across the higher chargeable element while it is being charged. The obtained value can be compared with a second threshold voltage. Once the voltage potential $V_C$ across the chargeable element exceeds the second threshold voltage, the LED switching element connected between the lower pair of connection terminals may be set in the first state again.

According to a third aspect of the invention, there is provided a control circuit for controlling M LED groups, wherein M is equal to or larger than one, wherein the LED groups are connected in series to each other if M is larger than one and each LED group comprises at least one LED, wherein the control circuit comprises:

- a supply-power line configured to be connected to a supply-power source which powers the LED groups;
- a plurality of connection terminals for connecting the LED groups to the control circuit such that each LED group is connected to a pair of connection terminals comprising an upper connection terminal and lower connection terminal, wherein
  - i. for two successive LED groups the lower connection terminal of a first of the two successive LED groups is either connected to or is the same as the upper connection terminal of a second of the two successive LED groups,
  - ii. a top connection terminal is connected to the supply-power line,
  - iii. a bottom connection terminal is configured to be connected to a ground,
- M LED switching elements, each connected between a corresponding pair of the connection terminals, and configured to be in parallel with a corresponding LED group, wherein each LED switching element has a first state corresponding with said LED group being on and a second state corresponding with said LED group being off,
- M chargeable elements each connected between a corresponding pair of the connection terminals, and configured to be in parallel with both a corresponding LED switching element and a corresponding LED group, wherein each chargeable element enables, when charged, the corresponding LED switching element to switch from the first state to the second state;
- a switch comprising:
  - i. a lighting mode wherein current flows through each LED group or the corresponding LED switching element and,
  - ii. a charging mode wherein current flows to the chargeable element, thereby charging the chargeable element.

The control circuit is suitable for driving M LED groups, wherein M is equal to or larger than one. In the context of this invention, each LED group is considered to comprise at least one LED, but can also comprise multiple LEDs, e.g. four LEDs in series. Those LEDs can be of the same rating or of a different rating, and they can be the same colour or different colours. If multiple LED groups are present, i.e. if M is larger than one, the multiple LED groups can be but do not need to be identical to each other. If M is larger than one, the LED groups are connected to each other in series.

The LED groups are connected, directly or indirectly, to a supply-power line which is configured to be connected to a supply-power source, which supply-power source powers the LED groups. The supply-power line is comprised by the control circuit, but the supply-power source does not need to be comprised by the control circuit. The supply-power source can comprises a voltage source or a current source. It can be a power converter such as Buck, Boost or flyback converter for providing a current.

The control circuit comprises a plurality of connection terminals which are adapted to connect a LED group to the control circuit. When connected, each LED group has an upper connection terminal and a lower connection terminal. For two successive LED groups, the lower connection terminal of the first of the two successive LED groups is either connected to or the same as the upper connection terminal of the second of the two successive LED groups. Thus, it is possible for the control circuit to comprise M pairs of connection terminals, such that each LED group can be connected to an individual pair of connection terminals. However, it is also possible for one or more connection terminals to be configured to be connected to more than one LED group. In that case, such a connection terminal serves as lower connection terminal for one LED group and as upper connection terminal for another LED group.

The LED groups are not part of the control circuit. It should be noted that, nevertheless, it is possible for the control circuit and the LED groups to be integrated or even to be arranged on a single physical board. Advantageously it is also possible that the LED groups are physically separated from the control circuit, e.g. on a separate physical board. It is also possible for the control circuit and the LED groups to be detachably or removably connected. This allows to connect any LED group to the control board, and to replace an individual LED or LED group, e.g. when it malfunctions or a different colour or colour temperature is desired.

In the control circuit according to the first aspect of the invention, a top connection terminal is connected, directly or indirectly, e.g. via one or more transistors, to the supply-power line and a bottom connection terminal is connected, directly or indirectly, e.g. via one or more transistors, to a ground. It should be noted that in the context of this invention, terms such as "first", "upper", "higher" and "top" are considered to indicate upstream of the flow of current relative to terms as "second", "last", "lower" or "bottom".

The control circuit according to the first aspect of the invention comprises M LED switching elements, each connected between an upper and a lower connection terminals. The LED switching element is in parallel with the corresponding LED group. As such, each LED group can be individually controlled by a LED switching element. That is, each LED group can individually be turned on, i.e. emitting light, or off, i.e. not emitting light. The LED switching element has a first state and a second state, wherein the first state corresponds with the LED group being on and the second state corresponds with the LED group being off. The LED switching element can be component such as any kind of BJT, FET, MOSFET or other transistor. In the first state, the LED switching behaves as an open circuit, such that the current flows through the LED group that is in parallel with the respective LED switching element. In the second state, the LED switching element is set to conduct current, such that substantially no current is conducted by the corresponding LED group. The LED switching element may e.g. be a power MOSFET, which advantageously has a high switching speed and good efficiency at low voltages.

The control circuit according to the first aspect of the invention further comprises M chargeable elements, also each connected between an upper and a lower connection terminals e.g. via diodes, and optionally comprising additional electrical components, e.g. diodes and/or capacitors, between said upper and lower connection terminal in series with the chargeable element. The chargeable element is in parallel with both the corresponding LED switching element and the corresponding LED group. The chargeable element enables, when charged, the LED switching element to switch from the first state to the second state. The chargeable element can e.g. be a capacitor which supplies a voltage that enables switching of a transistor, e.g. the gate-source voltage for a FET or the base-emitter voltage for a BJT, e.g. by being connected to the gate and the source or the base and the emitter.

By controlling which LED groups are on and which are off, characteristics of the emitted light such a brightness, intensity and/or colour can be controlled. In order for each LED group to be controlled properly, the corresponding LED switching element must be in the correct state, i.e. the first or the second state. For the LED switching element to be able to be in that correct state, the chargeable must be sufficiently charged. Since the chargeable element is in parallel with the LED switching element and the LED group, it will charge if there is a voltage drop over the LED switching element and the LED group. However, the LED switching element conducts when it is in the second state with substantially no voltage drop, thereby ensuring that substantially no current flows through the LED group. The chargeable element may not be charged when the corresponding LED group is turned off. Although the chargeable element may have been charged prior to the corresponding LED group being turned off, leakage currents will eventually cause the chargeable element to become uncharged. This may cause the corresponding LED switching element to undesirably switch to the first state, thereby causing the LED group to emit light. Thus, a LED switching element corresponding with a LED group that is turned out for a certain period of time cannot be controlled correctly anymore.

Therefore, the control circuit according to the third aspect of the invention further comprises a switch. The switch can be set in a lighting mode or in a charging mode. In the lighting mode, current flows through each LED group or the corresponding LED switching element. In the charging mode, current flows to the chargeable elements, thereby charging the chargeable elements. Thus, the control circuit according to the third aspect of the invention allows to charge the chargeable element, even if the corresponding LED group is off for an extended period of time. As such, correct working of the LED switching elements can be guaranteed.

In an embodiment of the third aspect of the invention, the control circuit further comprises a control unit. The control unit has an output terminal, by which it is adapted to control the LED switching element, e.g. by controlling the voltage at the gate or base of the LED switching element.

In an embodiment the switch comprises at least one transistor of FET, e.g. an nFET or an n-type JFET transistor, e.g. controlled by a processor, for switching between the charging mode and the lightning mode. In a further embodiment, the control unit controls the switch as well. The control unit in this embodiment has a second output terminal, by which it controls the switch.

In an embodiment of the third aspect of the invention, the switch is a mechanical switch.

In an embodiment of the third aspect of the invention, the chargeable elements are connected to a common charging node. In the charging mode, the switch is connected to the charging node as well, such that current flows from the switch to the chargeable elements. Between the charging node and each chargeable element, there may be a Zener diode. The Zener diodes are reversed when seen in the direction of the current. The Zener diodes ensure that the chargeable elements do not discharge to each other.

The third aspect of the invention further relates to a method for driving at least one LED group by means of a control circuit according to the third aspect of the invention. The method entails a step of setting the switch in the lighting mode during normal operation. As such, each LED group emits light if the corresponding LED switching element is in the first state. The method further comprises a step of setting the switch in the charging mode for a charging period. As such, the chargeable element is charged. The third aspect of the invention provides a solution for the charging of a chargeable element which is associated with a LED group that is turned off for an extended period of time. By setting the switch in the charging mode, the chargeable element is charged, thereby ensuring a continued correct functioning of the LED switching element.

In a possible embodiment of the method according to the third aspect of the invention, the charging period is preferably smaller than 1 ms, preferably smaller than 0.33 ms, preferably 0.033 ms. By keeping the charging period sufficiently small, the switching of the switch is not noticeable to the average observer. This can be understood as follows. If the switch is set from the lighting mode to the charging mode, no current flows through the one or more LED groups anymore. Since no current can be conducted by the LEDs, no light can be emitted either, even though some of the LED groups may be desired to emit light. Therefore, the switch can be set in the charging period only for a short period of time, thereby keeping the period of time that no light is emitted short as well. If this period of time is kept sufficiently short, the change in emitted light is not noticeable to the human eye and/or a digital camera. In a further embodiment, energy-storing elements such as capacitors or inductances can be arranged in an intelligent way to continue a flow of current through a certain LED group for a certain period of time.

In a possible embodiment of the method according to the third aspect of the invention, the switch alternates between a lighting period in the lighting mode and the charging period in the charging mode. This ensures that the chargeable elements stay charged or are being charged regardless of the status of the LED groups. The lighting period is large compared to the charging period, preferably at least 10 times larger, preferably at least 25 times larger. This allows to emit light for the majority of the time, and have relatively small periods wherein the emitted light is disrupted and chargeable element is charged. For example, the lighting period and the charging period combined may be 3.33 ms. For example, the lighting period may be 3 ms and the charging period may be 0.33 ms. As such, in a total period of 3.33 ms the switch will move to the charging mode for 0.33 ms, which will not be noticeable to the human eye.

In a possible embodiment of the method according to the third aspect of the invention, a time period $T_{off}$ is monitored for each LED group. The time period $T_{off}$ is then compared to an off-time limit. When the time period $T_{off}$ exceeds the off-time limit, the switch is set in the charging mode for the charging period, thereby charging the chargeable element. Thereafter, optionally the time period $T_{off}$ is reset to zero and the monitoring is repeated.

The time period $T_{off}$ corresponds to the period that the specific LED group is turned off and the switch is in the lighting mode. Thus, the time period $T_{off}$ corresponds to the time that the chargeable element is not being charged. The off-time limit represents the maximal period that a specific LED groups should be turned off while the switch is in the lighting period, before the switch should be set in charging period to charge the chargeable element. Thus, the off-time limit is determined based on the time it takes for the chargeable element to become uncharged. The off-time limit can be determined based on a theoretical model of the circuit, and/or on empirical data obtained by a prototype of the circuit, and/or on empirical data obtained by monitoring the behaviour of the actual circuit. When multiple LED groups are present, the off-time can be different for each chargeable element.

In a possible embodiment of the method according to the third aspect of the invention, a voltage potential $V_C$ across the chargeable element is measured. The measured voltage potential $V_C$ is compared to a threshold voltage. Before the measured voltage potential $V_C$ falls below the threshold voltage, the switch is set to the charging mode.

Monitoring the voltage potential $V_C$ can be achieved by any voltage measuring method known the skilled person. The threshold voltage can be predetermined and can be dependent on the voltage that is needed to ensure correct functioning of the corresponding LED switching element. The switch can be set to the charging mode for the charging period, but it is also possible to keep monitoring the voltage potential $V_C$ across the chargeable element. The obtained value can be compared with a second threshold voltage. Once the voltage potential $V_C$ across the chargeable element exceeds the second threshold voltage, the switch can be set back to the lighting mode It is noted that embodiments and methods described for charging the chargeable elements by controlling the switch according to the third aspect may also be applied for charging the chargeable element by controlling the lower LED switching element according to the second aspect of the invention and vice versa.

Examples of the invention will now be described with reference to the figures, in which like reference numerals indicate like features.

Figure 3A:
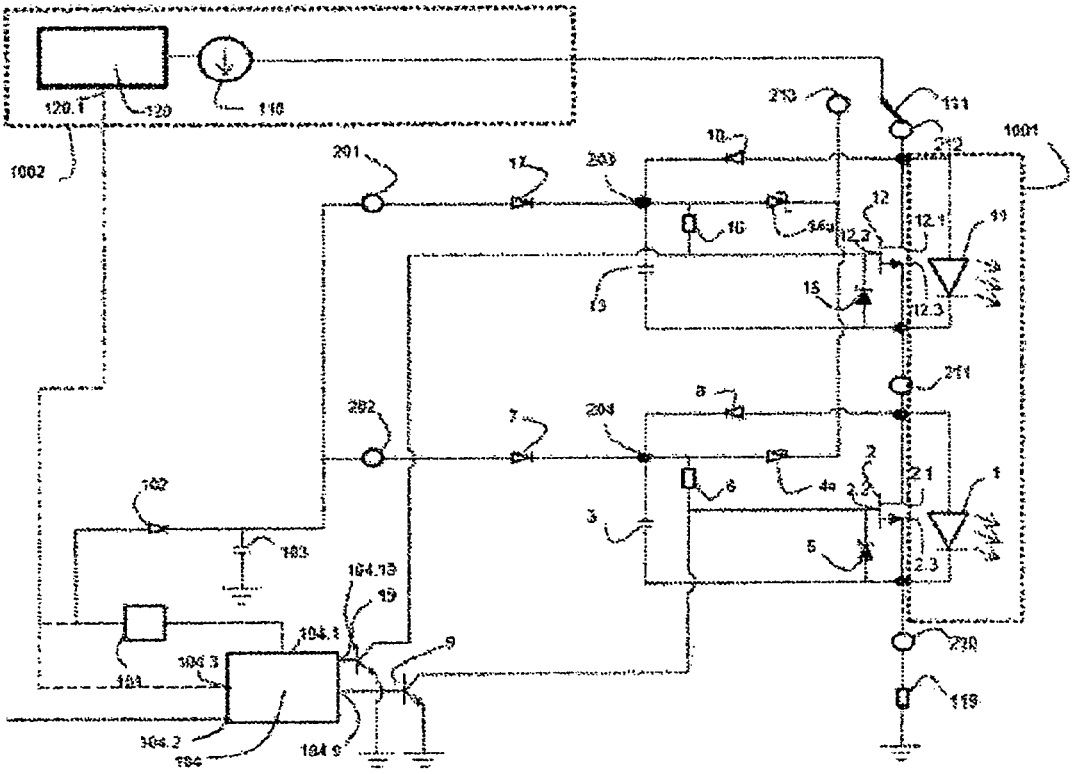

FIG. 3*a* shows an embodiment of a control circuit according to the third aspect of the invention, wherein the switch is in the lighting mode.

Figure 3B:
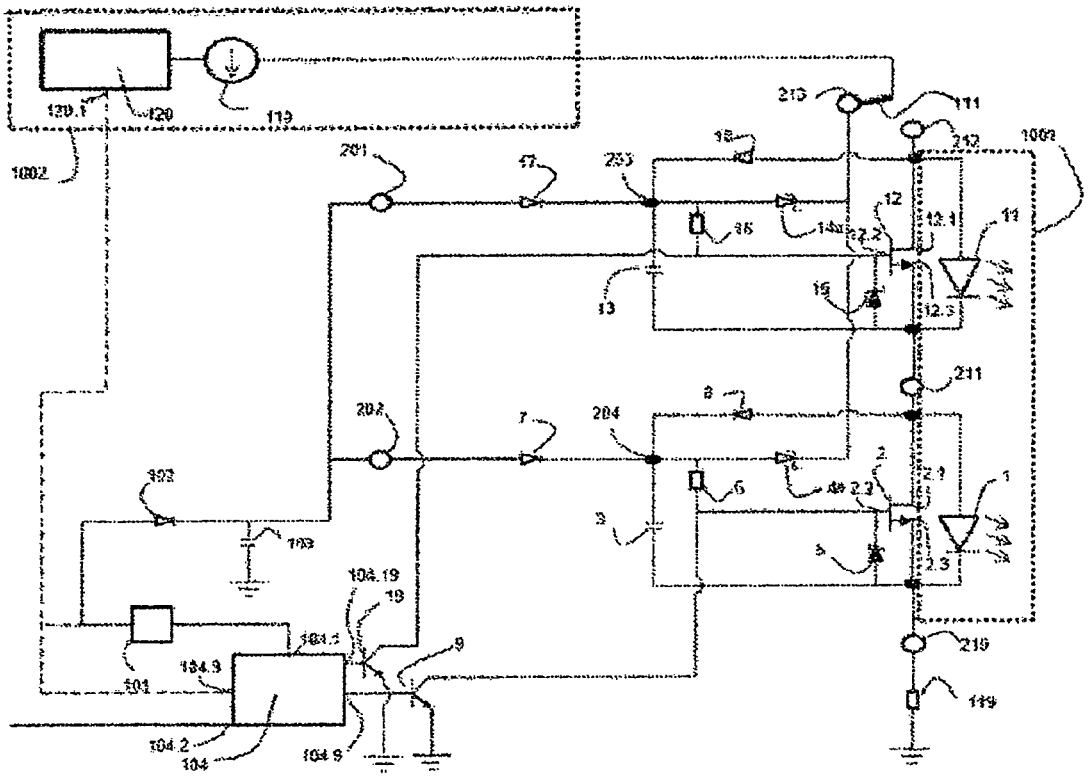

FIG. 3*b* shows an embodiment of a control circuit according to the third aspect of the invention, wherein the switch is in the charging mode.

Figure 1:
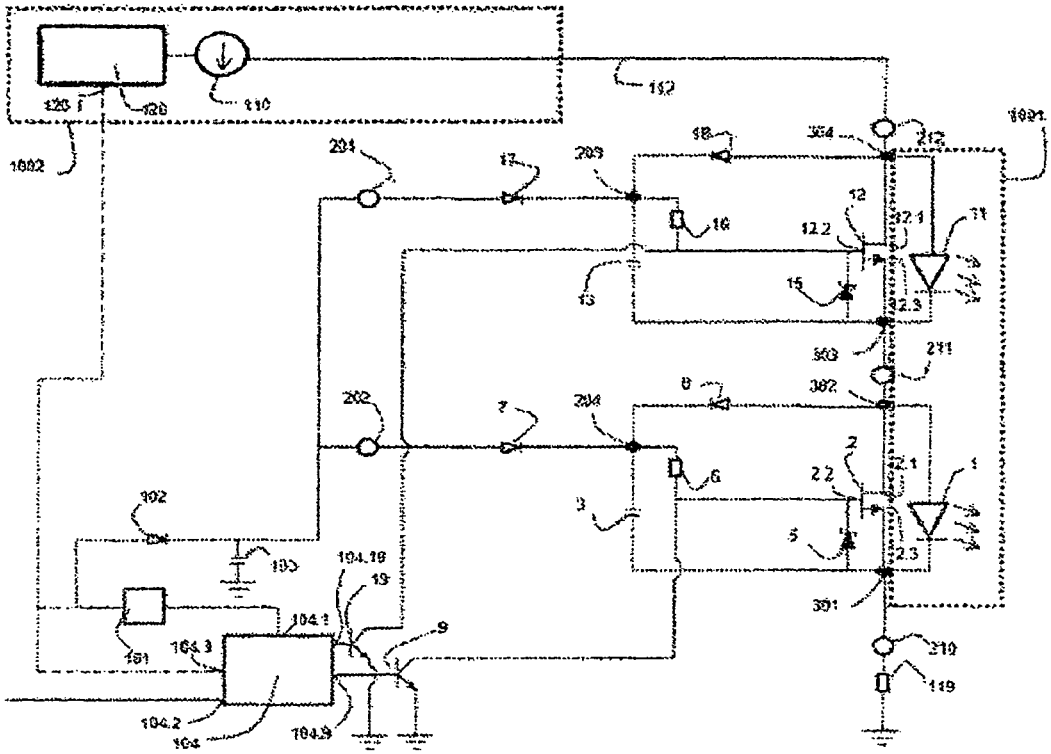
FIG. 1 shows an embodiment of a control circuit according to the first aspect of the invention.

FIG. 1 shows a possible embodiment of a control circuit according to the first aspect of the invention. In the shown example, the control circuit is connected to two LED groups 1 and 11 in series, which can be individually controlled. The LED groups 1,11 are schematically shown by a single LED symbol. In the current example, each LED group 1,11 is a multi group LED comprising four individual LEDs. It should be noted that it is possible to employ the same principle for any number of LED groups, which may comprise mutually different arrangements of LEDs, e.g. a different number and/or different ratings of LEDs. For example, any LED group may comprise any number, e.g. one, two, three, four or five, of LEDs. The LEDs in any LED group may e.g. be white, red, green or blue LEDs or combination thereof. It is further possible to control individual LEDs instead of LED groups comprising a plurality of LEDs. The control circuit comprises four connection terminals 301, 302, 303, 304, forming two pairs 301,302 and 303,304. LED group 1 is connected to the control circuit via connection terminals 301,302 and LED group 11 is connected to the control circuit via connection terminals 303, 304. LED group 1 has an upper connection terminal 302 and a lower connection terminal 301, and LED group 11 has an upper connection terminal 304 and a lower connection terminal 303. The lower connection terminal 303 of LED group 11 is connected to the upper connection terminal 302 of LED group 1. A top connection terminal, in this case the upper connection terminal 304 of LED group 11, is connected to a power-supply line 112 and a bottom connection terminal, in this case the lower connection terminal 301 of LED group 1, is connected to a ground via a resistor 119.

Between each upper connection terminal 302,304 and the corresponding lower connection terminal 301,303, the control circuit comprises LED switching elements, in this case FETs 2 and 12, and chargeable elements, in this case capacitors 3 and 13. FETs 2 and 12 enable the controlling of the LED groups 1 and 11 respectively. Each FET 2,12 has three terminals, i.e. a drain 2.1, 12.1, a gate 2.2, 12.2 and a source 2.3, 12.3. The FETs 2,12 have a first state and a second state. In the first state, the FET 2,12 behaves as an open circuit. Thus, current can flow through the corresponding LED group 1,11, resulting in the LED group 1,11 being on. In the second state, the FET 2,12 conducts. As such, current flows through the FET 2,12 instead of the LED group 1,11, resulting in the LED group 1,11 being off, i.e. not emitting light. The capacitor 3,13 provides a gate-source voltage for the corresponding FET 2,12. If the gate-source voltage is higher than a threshold voltage, the corresponding FET 2,12 conducts. Thus, the capacitors 3,13 enable correct working of the FETs 2,12 if they are charged sufficiently. In the shown example, a Zener diode 5,15 is provided between the source 2.3, 12.3 and the gate 2.2, 12.2 of the FET 2,12 for protection against overvoltage.

The control circuit further comprises a control unit 104 which is powered by a low-power source, in this case a voltage regulator 101, via a power input terminal 104.1. The control unit 104 further comprises a set-point terminal 104.2, by which the control unit 104 can receive a set-point signal. The set-point signal can come from a user input or an automated input and may represent desired characteristics of the emitted light, such as brightness, intensity, temperature or colour, after the start-up and/or during normal operation. Based on the set-point, the control unit 104 is configured to determine which LED group(s) 1,11 should emit light to obtain the desired characteristics represented by the set-point. By determining this, the control unit 104 determines a start-up state for each LED group 1,11. The start-up state corresponds with either being on or being off. In the current example, it is assumed that the start-up state of LED group 1 is on and the start-up state of LED group 11 is off. The shown example of the control unit 104 comprises two output terminals 104.9 and 104.19 by which the control unit 104 controls the LED switching elements via transistors 9,19 which are connected to the ground and to the gate 2.2, 12.2 of FETs 2,12. By providing a voltage, in this case 1V, to one of the output terminals 104.9, 104.19 which is higher than a threshold voltage of the corresponding transistor 9, 19, in this case 0.5V, the control unit 104 causes the gate 2.2, 12.2 of the FET 2,12 to be connected to the ground. The low-power source 101 in the current example provides a voltage of 5V, and is connected via diodes 7,17 to capacitors 3,13. Resistors 6,16 are provided, and are preferably relatively large resistances in order to limit the current going to the ground via transistors 9,19 when those are set to conduct.

The LED groups 1,11 are powered by a current source 110, to which the upper connection terminal 304 of LED group 11 is connected via the supply power line 112. The current source 110 may e.g. supply a current in the range of 300-1500 mA. The current source 110 in this example is controlled by a driver 120 which provides a substantially constant current. Although the driver 120 is schematically represented as a rectangle, in practice it comprises multiple components among which, in this example, a Buck converter and a controller. The controller of the driver 120 comprises a communication terminal 120.1, which is connected to a communication terminal 104.3 of the control unit 104 of the control circuit. It should be noted that although in the shown embodiment the communication terminal 104.3 and the set-point terminal 104.2 are depicted as separate terminals, they may also be embodied as a single terminal. The set-point may e.g. be received as part of the communication with the driver 120.

In the shown example, the driver 120 and control unit 104 communicate with each other via a bus-signal. Said bus-signal may for example be 5V when high. Advantageously this bus-signal is sufficient to charge the low-power source 101, and is connected to the low-power source 101. As such no separate connection is required for charging the low-power source 101.

In the shown example, the LED groups 1,11 are located on a LED board 1001 which is physically separate from the control circuit, just as a driver board 1002 which includes the driver 120 and the current source 110. It should be noted that different construction are possible as well, e.g. all components could be one a single board, one of the driver board 1002 and the LED board 1001 could be on the same board as the control circuit, or the driver board 1002 and LED board 1001 may be on the same board. Various LED groups 1,11 may also be one separate boards from each other. Furthermore, the control circuit does not need be comprised by one single board.

The working principle of the scheme depicted in FIG. 1 is as follows. Initially the current source 110 does not power the LED groups 1,11, e.g. because the driver 120 is not supplying power. Thus, no current flows through the supply-power line 112. The low-power source 101 does supply a voltage, in this example of 5V. The charging of low-power source 101 is achieved by supplying a high signal through the bus-signal of the communication between the driver 120 and the control unit 104. The transistors 9, 19 are initially set by the control unit 104 not to conduct. Via diode 102 and capacitor 103, nodes 201 and 202 are brought to substantially 5V. Subsequently, the gates 2.2 and 2.12 of the FETs 2 and 12 are at substantially 5V as well, via diodes 7,17 and resistors 6,16. Also capacitors 3, 13 are at 5V. Diodes 7, 17, 102 are preferably schottky diodes as these have a low forward voltage drop. The FETs 2,12 are selected to have a switching threshold which is below the voltage supplied by the low-power source 101. If the gate-source voltage of one of the FETs 2,12 is above the switching threshold, said FET 2,12 will be set to conduct. In the current example, the switching threshold of both FETs 2,12 is 3V, but it is not needed for both FETs 2,12 to have the same switching threshold. The lower connection terminal 301 of LED group 1 is at substantially 0V since no current flows through resistor 119, which is connected to the ground. As such, the source 2.3 of FET 2 is at substantially 0V as well. FET 2 will be set to conduct, since the gate-source voltage is 5V, which is larger than the switching threshold of 3V. Since FET 2 is set to conduct, an electrical connection between the lower connection terminal 301 and the upper connection terminal 302 of LED group 1 is formed and the upper connection terminal 302 is at substantially 0V as well.

The lower connection terminal 303 of LED group 11 is also at substantially 0V, since it is in electrical connection with the upper connection terminal 302 of LED group 1. As capacitor 13 is still at substantially 5V, the gate-source voltage of FET 12 is above the threshold voltage, and the FET 12 will conduct. As such, an electrical connection between the lower connection terminal 303 and the upper connection terminal 304 of LED group 11 is formed, and the upper connection terminal 304 is at substantially 0V as well. As can be seen, all FETs 2,12 are set to their second state wherein they conduct, and all lower connection terminals 301,303 and upper connection terminals 302,304 are at substantially 0V. It is clear that in a situation with more than two LED groups, the same working principle applies to and is repeated for all FETs.

In order to start the lighting, i.e. to cause at least one of the LED groups 1,11 to emit light, the control unit 104 will set at least one of the transistors 9,19 to conduct. In the current example, the control unit 104 sets transistor 9 to conduct because the start-up state of LED group 1 is on while the start-up state of LED group 11 is off, but this may be different depending on the set-point signal received via the set-point terminal 104.2. Since the transistor 9 is connected to the ground, the gate of FET 2 is at substantially 0V. As such, the gate-source voltage of FET 2 is below the switching threshold voltage and FET 2 is set to not conduct and brought to the first state.

The driver 120 can be informed that it may safely supply current with the current source 110. Current will then flow between top terminal 304 and bottom connection terminal 301. Since FET 12 is still in the second state and set to conduct, the current will flow via said FET 12 instead of LED group 11. FET 2 however, is in the first state and not set to conduct because transistor 9 is set to conduct, resulting in the current being conducted by LED group 1. Thus, LED group 1 emits light while LED group 11 does not. As can be seen, the control circuit as depicted in FIG. 1 allows for a controlled start-up. By controlling the FETs 2,12 via transistors 9,19 the control unit 104 can now control the characteristics of the emitted light.

Of course it also possible to initially start conducting with the current source 110 while all LED groups 1, 11 are off, thus not emitting light. The control unit 104 can then e.g. gradually increase the emitted light by turning one or more LED groups 1,11.

When individual LED groups 1,11, which are in series connected to each other, are controlled, often a circuit somewhat similar to the one depicted in FIG. 1 is used. That is, each individual LED group 1,11 is controlled by a LED switching element, in this case FETs 2,12, in parallel. A chargeable element, in this case capacitors 3,13, is in parallel to both the LED group 1,11 and the LED switching element, wherein the chargeable element enables the LED switching element to control the LED group 1,11. However, if a LED group 1,11 is turned off for an extended period of time, correct working of the control circuit can become uncertain. This can be understood as follows.

Continuing from the situation after the start-up as described above, wherein LED group 1 emits light, but LED group 11 does not. In the current example, LED group 1 comprises 4 individual red LEDs in series, each with a voltage drop of approximately 2.5V when emitting light. Hence, the voltage drop over LED group 1 is approximately 10V. As such, the voltage at node 211 rises to 10V, as will the voltage at node 212 because FET 12 conducts the current. Since node 211 is at 10V and the voltage drop over capacitor 13 is still 5V, the voltage at a node 203 will rise to 15V. Capacitor 3 will be charged to approximately 10V via diode 8. Note that in practice it might be preferred to provide an impedance in series with diode 8 to limit peak currents. As the voltage at the capacitors 3,13 is now above the voltage supplied by low-power source 101, it will not be possible to charge the capacitors 3,13 via low-voltage supply 101. Reverse-based diodes 7,17 will prevent current to flow from the current source 110 towards the low-voltage supply 101 and the control unit 104.

As long as FET 12 conducts the current, node 211 and node 212 will be at a substantially equal voltage. Since the capacitor is connected to both node 211 and node 212, it is not possible to charge the capacitor 13 via diode 18. Neither is it possible to charge the capacitor 13 via low-power source 101, since the voltage supplied by the low-power source 101 is too low. Thus, capacitor 13 will not be charged. Although diode 18 is meant to prevent a flow of current that would cause capacitor 13 to lose its voltage, there will still occur some leakage currents which will eventually cause the capacitor 13 to lose its potential. Depending on the components and the modulation cycle of the circuit, capacitor 13 may lose its potential in a range of a few modulation cycles and/or the range of a few milliseconds. Subsequently, if LED group 11 is turned off for a sufficiently long period of time, the gate-source voltage of FET 12 will drop below the switching threshold and FET 12 will stop conducting current. Hence, the current will flow through LED group 11 which will start emitting light. An undesired situation has been created because capacitor 13 could not be charged as long as LED group 11 is turned off, causing LED group 11 to emit light while being intended to be turned off. Both the second and the third aspect of the invention can provide a solution to this problem.

Figure 2:
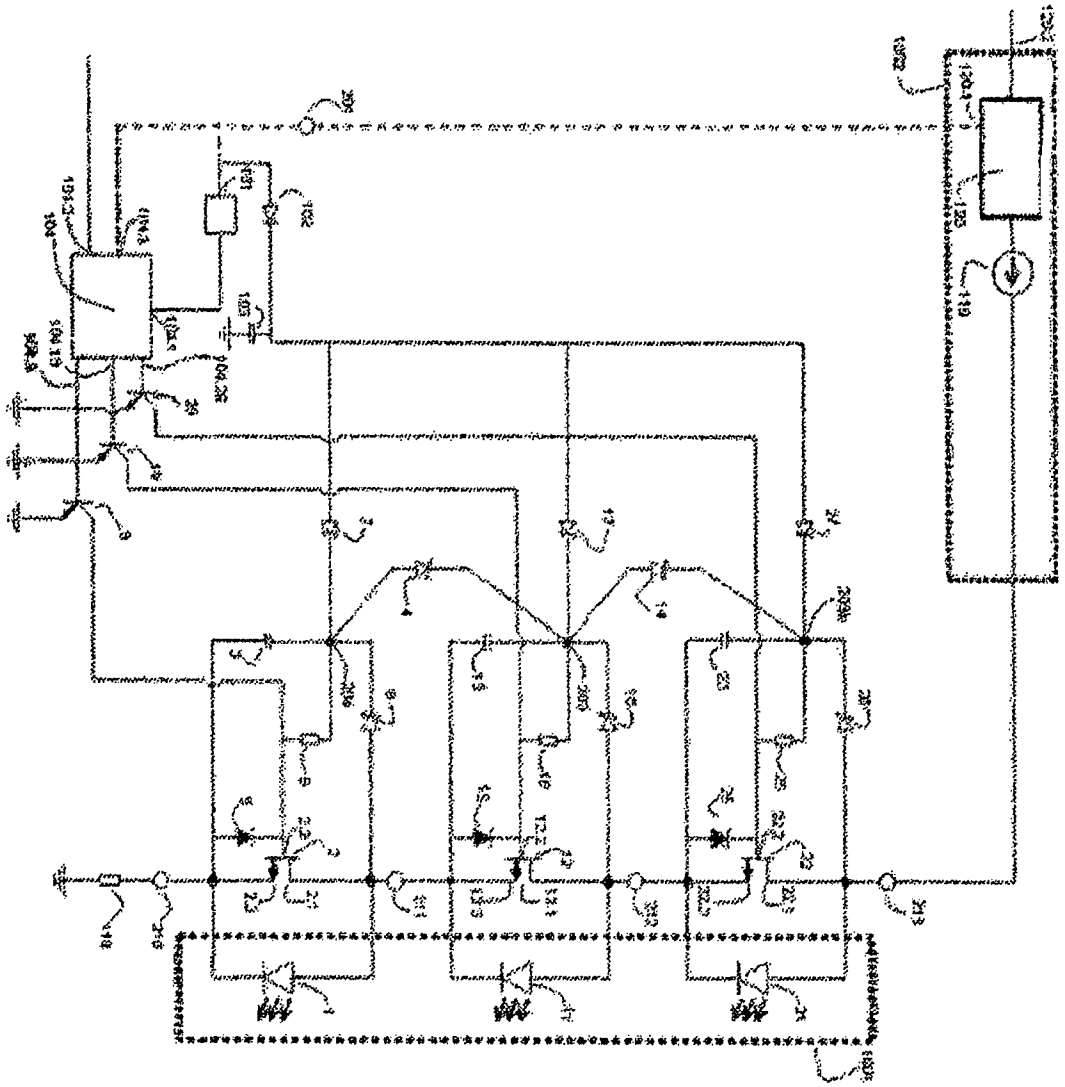
FIG. 2 shows an embodiment of a control circuit according to the second aspect of the invention.

FIG. 2 shows an embodiment of control circuit according to the second aspect of the invention. Components which are similar to the ones shown in FIG. 1 are indicated by the same reference numerals. In the embodiment shown in FIG. 2 a third LED group 21 is connected in series above LED group 11, which is again connected between an upper connection terminal and a lower connection terminal, between which also a LED switching element, being a FET 22, and a chargeable element, being a capacitor 23, are connected. In addition to the components shown in FIG. 1, the embodiment in FIG. 2 further comprises two diodes 4,14. Diode 4 provides an additional connection from the top of capacitor 3 to the top of capacitor 13, via nodes 203 and 204. Diode 14 provides an additional connection from the top of capacitor 13 to the top of capacitor 23, via nodes 203 and 203*b*.

For simplicity it is assumed that all LED groups 1, 11, 21 comprise four red LEDs in series each causing a voltage drop of 2.5V, thus 10V per LED group 1, 11, 21 when the LED group is on. However other arrangements are possible, e.g. with each LED group 1, 11, 21 having different arrangements from each other. Prior to conducting current with current source 110, the capacitors 3, 13, 23 have been charged, e.g. according to the method according to the first aspect of the invention, in order to provide sufficient voltage for the FETs 2, 12, 22 to be set in the second state wherein they conduct. For example, the voltage over each of the capacitors 3, 13, 23 prior to conducting current may have been 5V, the threshold voltage of the FETs 2, 12, 22 being e.g. 3V.

Assume a situation wherein LED group 21 is off, i.e. FET 22 in the second state and conducting, and LED groups 1 and 11 are on, i.e. FETs 2 and 12 in the first state and not conducting. Neglecting further for simplicity the voltage drop over resistance 119, the voltage at node 211 in this situation is substantially 10V, while the voltage at nodes 212 and 213 is substantially 20V. The bottom of capacitor 23, being connected to node 212 is at 20V as well, initially bringing the top of capacitor 23 to 25V, as the voltage across the capacitor 23 was already 5V. However as explained above leakage currents will cause the voltage across the capacitor 23 to drop. If said voltage drops below the threshold voltage of FET 22, the LED group 21 will turn on and emit undesired light. The path provided by diode 14 according to the second aspect of the invention provides a solution for this.

Since the LED group 11 is on with a voltage drop of 10V across it, the top of capacitor 13 is charged to 20V while the bottom is at 10V. To avoid the voltage across to capacitor 23 to drop too low, LED group 11 may be turned off. This will bring node 212 at the same voltage as node 211, being 10V. The bottom of capacitor 23, being connected to node 212, is also brought to 10V and since the voltage across capacitor 23 is low, e.g. 3.1V, the top of the capacitor 23 is at 13.1V. The top of capacitor 13 however is still at 20V. Since this is higher than the top of capacitor 23, a path via diode 14 is provided via which the top of capacitor 23 is charged, preventing the voltage across capacitor 23 to drop below the threshold voltage of FET 22. Note that in practice it might be preferred to provide an impedance in series with diodes 4,14 to limit peak currents. The second aspect of the invention thus provides an alternative/additional path to charge capacitor 23, which is connected in parallel with a higher pair of connection terminals, with capacitor 13, which is connected between a lower pair of connection terminals. In this context the higher pair of connection terminals is arranged between the top connection terminal and the lower pair of connection terminals, i.e. "higher" meaning upstream as normally seen in current relative to "lower". In this context capacitor 23 can also be referred to as the higher capacitor and capacitor 13 as the lower capacitor. In the embodiment shown in FIG. 2 capacitor 13 can similarly function as the higher capacitor being chargeable by lower capacitor 3.

The diodes 4, 14 are provided to prevent capacitor 23 from discharging towards capacitor 13 and capacitor 13 towards capacitor 3. Without said diodes 4, 14 the tops of all the capacitors 3, 13, 23 would converge to the same voltage potential.

Preferably FET 12 is switched alternating between the first state and the second state. The period that FET 12 is in the first state may e.g. be 3 ms and the period that the FET 12 is in the second state may be 0.33 ms. As such, in a total period of 3.33 ms LED group 11 will be turned off for 0.33 ms, which will not be noticeable to the human eye.

The alternating switching of FET 12 may occur when there is a risk that the capacitor 23 loses too much voltage potential, e.g. when the LED group 21 is turned off and/or based on calculations and/or measurements of the voltage potential of capacitor 23.

The alternating switching of the FET 12 may also occur continuously, optionally for all FETs 2, 12, 22. For example, the control circuit may be defined that emitted light at maximal intensity actually corresponds with the LED groups 1, 11, 21 being on slightly less than 100% of the time, e.g. 90%, 95% or 99% of the time. During each modulation cycle all LED groups 1, 11, 21 can then be turned off for the remaining time, thereby allowing to ensure that capacitors 13, 23 are always sufficiently charged by using the charging path via diode 4 or 14, respectively, when required. A modulation cycle may e.g. be in the range of a few millisecond, e.g. 3.33 ms, such that the switching off of the LED groups 1, 11, 21 occurs at a frequency which is not visible for the human eye or a camera. Note that is also possible to switch all LED groups 1, 11 except the highest LED group 21, since there is no higher capacitor to charge.

It should be noted that although the second aspect of the invention is described with respect to the control circuit according to the first aspect of the invention, the second aspect of the invention is not limited thereto and can be implemented in any circuit comprising chargeable elements in parallel with LED groups.

It should further be noted that although FIG. 2 depicts three LED groups 1, 11, 21, it is also possible to apply the second aspect with two LED groups. However the invention is in particular advantageous for more than two LED groups 1, 11, 21, because a low-power source such as voltage regulator 101 is usually not able to provide sufficient voltage to charge capacitor 23 when LED group 1 is on, even if LED group 11 is turned off. Furthermore, it may be desirable to arrange the LED group that will turned on most often as being LED group 1 in FIG. 2, since this LED group cannot be charged by lower LED groups.

FIG. 3*a* and FIG. 3*b* illustrate a third aspect of the invention which can be used alternatively to or in combination with the second aspect of the invention. According to the third aspect of the invention, a switch 111 is provided. The switch 111 has a lighting and a charging mode. In the lighting mode, which is depicted in FIG. 3*a*, the current source 110 is connected to node 212, thereby supplying current to the LED groups 1,11. FIG. 3*b* shows the switch 111 in the charging mode. In the charging mode, the switch 111 is connected to charging node 213. This allows to charge the capacitors 3,13 even if the corresponding LED group 1,11 is turned off for an extended period of time. For this purpose, charging node 213 is connected to each of the capacitors 3,13 via a reversed Zener diode 4*a*,14*a*. For the explanation of the working principle, the example described above with respect to FIG. 1 is continued.

Initially, the switch 111 is in the lighting mode, i.e. connected to node 212, as shown in FIG. 3*a*, LED group 1 is conducting current and emitting light, while LED group 11 is not emitting light. For simplicity the voltage drop over resistor 119 is neglected. Node 210 is at 0V, node 211 is at 10V and node 212 is at 10V as well, because FET 12 is conducting. Capacitor 3 is charged to approximately 10V via diode 8. To allow charging of capacitor 13, the switch 111 is now switched to the charging mode, i.e. connected to charging node 213, as is depicted in FIG. 3*b*. The current source 110 now enables a flow of current, through inversed Zener diodes 4*a*,14*a*, to the top of the capacitors 3,13. As such, the capacitors 3,13 are charged. The Zener diodes 4*a*,14*a* ensure that the capacitors 3,13 do not discharge towards each other. In case the Zener diodes 4*a*,14*a* would not be present, the tops of capacitors 3,13 would be connected to each other and would discharge to be at the same potential. The Zener diodes 4*a*,14*a* will only conduct in their reversed direction, i.e. towards the corresponding capacitor 3,13, if the Zener voltage of the respective Zener diode is reached. That is, only if the top of a particular capacitor, e.g. 13, is at a voltage potential that is larger than the top of another capacitor, e.g. 3, by more than the Zener voltage of the corresponding Zener diode, e.g. 4*a*, then current will flow from the first capacitor 13 to the second capacitor 3. As can be seen, the charging mode of the switch 11 allows to charge the capacitor 13 even if LED group 11 is set to be off for an extended period of time. It should be noted that although the third aspect of the invention is described with respect to the control circuit according to the first aspect of the invention, the third aspect of the invention is not limited thereto and can be implemented in any circuit comprising chargeable elements in parallel with LED groups.

The switch 111 as shown in FIG. 3*a* and FIG. 3*b* is a mechanical switch, which in the lighting mode makes contact with node 212 and in the charging mode makes contact with charging node 213. However, it is also possible to implement the switch 111 with an electronic circuit, e.g. comprising transistors and/or mosFETs.

The third aspect of the invention, which also relates to a method for driving the control circuit comprising the switch 111, can be implemented in various ways. In one possible embodiment, switch 111 alternates between a lighting period in the lighting mode and the charging period in the charging mode. This ensures that the capacitors 3,13 stay charged or are being charged regardless of whether LED groups 1,11 are turned on or off. The lighting period is large compared to the charging period. This allows to emit light for the majority of the time, and have relatively small periods wherein the emitted light is disrupted and the capacitors 3,13 are charged. The lighting period may be 3 ms and the charging period may be 0.33 ms. As such, in a total period if 3.33 ms the switch 111 will move to the charging mode for 0.33 ms, which will not be noticeable to the human eye.

In a possible embodiment of the method according to the third aspect of the invention, a time period $T_{off}$ is monitored for each LED group 1,11. The time period $T_{off}$ corresponds to the period that the specific LED group 1,11 is turned off and the switch 111 is in the lighting mode. Thus, the time period $T_{off}$ corresponds to the time that the capacitor 3,13 is not being charged. The time period $T_{off}$ is then compared to an off-time limit. The off-time limit represents the maximal period that the specific LED group 1,11 should be turned off while the switch 111 is in the lighting period, before the switch 111 should be set in charging period to charge the capacitor 3,13. Thus, the off-time limit is determined based on the time it takes for the capacitor 3,13 to become uncharged. While the time period $T_{off}$ is monitored separately for both LED groups 1,11 when one of both time period $T_{off}$ exceeds the off-time limit, the switch 111 is set in the charging mode for the charging period. As such, both capacitors 3,13 are charged. Thereafter, both time periods $T_{off}$ are reset to zero and the monitoring is repeated.

In a possible embodiment of the method according to the third aspect of the invention, a voltage potential $V_C$ across each capacitor 3,13 is measured. This can be achieved by any voltage measuring method known to the skilled person. The measured voltage potential $V_C$ is compared to a threshold voltage. The threshold voltage can be predetermined and can be dependent on the voltage that is needed to ensure correct functioning of the corresponding FET 2,12. When the measured voltage potential $V_C$ falls below the threshold voltage, the switch is set to the charging mode for the charging period.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

A single processor or other unit may fulfil the functions of several items recited in the claims.

For the sake of simplicity minor voltage drops over components which are not crucial for the understanding of the invention have been neglected in this text. Of course in practice these components and other factors may result in losses, which should be taken into account when selecting components for a real-life design of the invention.

The invention claimed is:

1. A method for a controlled start-up of N LED groups by means of a control circuit, wherein the LED groups are connected to each other in series, each LED group comprises at least one LED, and N is larger than one;

wherein the control circuit comprises:

a supply-power line configured to be connected to a supply-power source which powers the LED groups;

a plurality of connection terminals for connecting the LED groups to the control circuit such that each LED group is connected to a pair of connection terminals comprising an upper connection terminal and lower connection terminal, wherein i. for two successive LED groups the lower connection terminal of a first of the two successive LED groups is either connected to or is the same as the upper connection terminal of a second of the two successive LED groups, ii. a top connection terminal is connected to the supply-power line, and iii. a bottom connection terminal is configured to be connected to a ground, N LED switching elements, each connected between a corresponding pair of the connection terminals, and configured to be in parallel with a corresponding LED group, wherein each LED switching element has a first state corresponding with said LED group being on and a second state corresponding with said LED group being off, N chargeable elements each connected between a corresponding pair of the connection terminals, and configured to be in parallel with both a corresponding LED switching element and a corresponding LED group, wherein each chargeable element enables, when charged, the corresponding LED switching element to switch from the first state to the second state; and a low-power source;

wherein the method comprises the following steps:

prior to supplying power via the supply-power line:

setting all LED switching elements in the second state by charging the chargeable elements with the low-power source, and supplying power via the supply-power line.

2. The method according to claim 1, further comprising the following step:

prior to supplying power via the supply-power line and after all LED switching elements have been set in the second state, setting the LED switching element corresponding to each LED group that is desired to be on after the start-up in the first state.

3. The method according to claim 1, wherein the control circuit further comprises:

a control unit, wherein the control unit comprises:

i. a set-point terminal for receiving a set-point signal representing a desired illumination of the LED groups, ii. at least one output terminal for controlling the LED switching elements, and iii. optionally a communication terminal for receiving a communication signal from a driver, wherein the method further comprises the following steps:

prior to supplying power via the supply-power line:

determining, with the control unit, for each LED group a start-up state based on the set-point signal, wherein the start-up state corresponds with either the LED group being on or being off, setting, with the control unit, the LED switching element corresponding to each LED group for which the start-up state is on in the first state, preferably at least initially charging the low-power source with the set-point signal or the communication signal.

4. A control circuit for use in a controlled start-up of N LED groups, wherein N is larger than one, wherein the LED groups are connected in series to each other and each LED group comprises at least one LED, wherein the control circuit comprises:

a supply-power line configured to be connected to a supply-power source which powers the LED groups;

a plurality of connection terminals for connecting the LED groups to the control circuit such that each LED group is connected to a pair of connection terminals comprising an upper connection terminal and lower connection terminal, wherein i. for two successive LED groups the lower connection terminal of a first of the two successive LED groups is either connected to or is the same as the upper connection terminal of a second of the two successive LED groups, ii. a top connection terminal is connected to the supply-power line, and iii. a bottom connection terminal is configured to be connected to a ground, N LED switching elements, each connected between a corresponding pair of the connection terminals, and configured to be in parallel with a corresponding LED group, wherein each LED switching element has a first state corresponding with said LED group being on and a second state corresponding with said LED group being off, N chargeable elements each connected between a corresponding pair of the connection terminals, and configured to be in parallel with both a corresponding LED switching element and a corresponding LED group, wherein each chargeable element enables, when charged, the corresponding LED switching element to switch from the first state to the second state; and a low-power source.

5. The control circuit according to claim 4, wherein the control circuit comprises a control unit, which comprises:

i. a set-point terminal for receiving a set-point signal representing a desired illumination of the LED groups and optionally for communicating with a driver, ii. at least one output terminal for controlling the LED switching elements, and iii. optionally a communication terminal for receiving a communication signal from a driver wherein preferably the low-power source is configured to be charged by the set-point signal or the communication signal.

6. A control circuit for controlling X LED groups, wherein X is larger than one, wherein the LED groups are connected in series to each other and each LED group comprises at least one LED, wherein the control circuit comprises:

a supply-power line configured to be connected to a supply-power source which powers the LED groups;

a plurality of connection terminals for connecting the LED groups to the control circuit such that each LED group is connected to a pair of connection terminals comprising an upper connection terminal and lower connection terminal, wherein i. for two successive LED groups the lower connection terminal of a first of the two successive LED groups is either connected to or is the same as the upper connection terminal of a second of the two successive LED groups, ii. a top connection terminal is connected to the supply-power line, and iii. a bottom connection terminal is configured to be connected to a ground, X LED switching elements, each connected between a corresponding pair of the connection terminals, and configured to be in parallel with a corresponding LED group, wherein each LED switching element has a first state corresponding with said LED group being on and a second state corresponding with said LED group being off, and X chargeable elements each connected between a corresponding pair of the connection terminals, and configured to be in parallel with both a corresponding LED switching element and a corresponding LED group, wherein each chargeable element enables, when charged, the corresponding LED switching element to switch from the first state to the second state;

wherein a top of at least one of the X chargeable elements, which is connected between a lower pair of connection terminals, is connected via a diode with a top of another one of the X chargeable elements, which is connected between a higher pair of connection terminals, the lower pair of connection terminals being arranged between the higher pair of connection terminals and the ground.

7. The control circuit according to claim 6, wherein the higher pair of connection terminals and the lower pair of connection terminals are subsequently arranged pairs of connection terminals, the lower connection terminal of the higher pair of connection terminals either being connected to or being the same as the upper connection terminal of lower pair of connection terminals.

8. The control circuit according to claim 6, wherein the tops of X-1 of the X chargeable elements are connected via a diode with a top of another one of the X chargeable elements, which is connected between a pair of connection terminals subsequently arranged closer to the top connection terminal.

9. A method for operating X LED-groups with a control circuit according to claim 6, the method comprising the following steps:

charging the chargeable element connected between the higher pair of connection terminals by setting the LED switching element connected between the lower pair of connection terminals in the second state.

10. The method according to claim 9, wherein the chargeable element connected between the higher pair of connection terminals is charged by the chargeable element connected between the lower pair of connection terminals, wherein optionally the LED switching element connected between the higher pair of connection terminals is in the second state before and during the charging, and the LED switching element connected between the lower pair of connection terminals is in the first state before being switched to the second state to charge the chargeable element connected between the higher pair of connection terminals.

11. The method according to claim 9, further comprising the step of switching the LED switching element connected between the lower pair of connection terminals alternating between the first state and the second state, wherein a period that the LED switching element is in the first state is preferably large compared to a period that the LED switching element is in the second state, preferably at least 10 times larger, preferably at least 25 times larger; and wherein alternating switching of the lower LED switching element occurs when there is a risk that the higher chargeable element loses too much voltage potential when the higher LED group is turned off, and/or based on calculations and/or measurements of the voltage potential of the higher chargeable element, or wherein the alternating switching of the lower LED switching element occurs continuously, optionally for multiple or all LED switching elements.

12. The method according to claim 9, further comprising the following steps:

monitoring a time period $T_{off}$ for the LED group between the higher pair of connection terminals, when the respective LED group is turned off, comparing $T_{off}$ with an off-time limit, charging the chargeable element connected between the higher pair of connection terminals when the $T_{off}$ exceeds off-time limit.

13. The method according to claim 9, further comprising the following steps:

monitoring a voltage potential $V_C$ over the chargeable element between the pair the higher pair of connection terminals, comparing the voltage potential $V_C$ to a threshold voltage, charging the chargeable element connected between the higher pair of connection terminals before the voltage potential $V_C$ falls below the threshold voltage.

14. A control circuit for controlling M LED groups, wherein M is equal to or larger than one, wherein the LED groups are connected in series to each other if M is larger than one and each LED group comprises at least one LED, wherein the control circuit comprises:

a supply-power line configured to be connected to a supply-power source which powers the LED groups;

a plurality of connection terminals for connecting the LED groups to the control circuit such that each LED group is connected to a pair of connection terminals comprising an upper connection terminal and lower connection terminal, wherein i. for two successive LED groups the lower connection terminal of a first of the two successive LED groups is either connected to or is the same as the upper connection terminal of a second of the two successive LED groups, ii. a top connection terminal is connected to the supply-power line, iii. a bottom connection terminal is configured to be connected to a ground, M LED switching elements, each connected between a corresponding pair of the connection terminals, and configured to be in parallel with a corresponding LED group, wherein each LED switching element has a first state corresponding with said LED group being on and a second state corresponding with said LED group being off, M chargeable elements each connected between a corresponding pair of the connection terminals, and configured to be in parallel with both a corresponding LED switching element and a corresponding LED group, wherein each chargeable element enables, when charged, the corresponding LED switching element to switch from the first state to the second state;

a switch comprising:

i. a lighting mode wherein current flows through each LED group or the corresponding LED switching element, and ii. a charging mode wherein current flows to the chargeable element, thereby charging the chargeable element.

15. A method for operating M LED groups by means of the control circuit according to claim 14, wherein the method comprises the followings steps:

setting the switch in the lighting mode during normal operation, such that each LED group emits light if the corresponding LED switching element is in the first state;

setting the switch in the charging mode for a charging period, thereby charging the chargeable elements, wherein the charging period is smaller than 0.33 ms.

16. The method according to claim 15, wherein the switch alternates between a lighting period in the lighting mode and the charging period in the charging mode, wherein the lighting period is large compared to the charging period, preferably at least 10 times larger.

17. The method according to claim 15, wherein the method further comprises the following steps:

monitoring a time period $T_{off}$ for every LED group, when the respective LED group is turned off and the switch is in the lighting mode, comparing $T_{off}$ with an off-time limit, setting the switch to the charging mode for the charging period when $T_{off}$ exceeds the off-time limit.

18. The method according to claim 15, wherein the method further comprises the following steps:

monitoring a voltage potential $V_C$ over each of the chargeable elements, comparing the voltage potential $V_C$ to a threshold voltage, setting the switch to the charging mode for the charging period when $V_C$ falls below the threshold voltage.

19. A system comprising the control circuit according to claim 4 and a LED fixture comprising the LED groups.

20. The method according to claim 15, wherein the charging period is smaller than 0.033 ms.

21. The method according to claim 16, wherein the lighting period and the charging period combined are 3.33 ms.

* * * * *